US006023206A

United States Patent [19]

Henderson et al.

[11] Patent Number: 6,023,206

[45] Date of Patent: Feb. 8, 2000

[54] SLOT LINE BAND PASS FILTER

[75] Inventors: Bert C. Henderson, Sunnyvale; Clifford A. Mohwinkel, San Jose, both of Calif.

[73] Assignee: Endgate Corporation, Sunnyvale, Calif.

[21] Appl. No.: 08/943,268

[22] Filed: Oct. 3, 1997

[51] Int. Cl.[7] ..... H01P 1/203

[52] U.S. Cl. ..... 333/204; 333/219

[58] Field of Search ..... 333/204, 219, 333/238, 246, 205

[56] References Cited

U.S. PATENT DOCUMENTS

| | | | |
|---|---|---|---|
| 3,753,167 | 8/1973 | Cohn | 333/204 |
| 5,770,987 | 6/1998 | Henderson | 333/204 |
| 5,825,263 | 10/1998 | Falt | 333/204 |

OTHER PUBLICATIONS

Lin et al. "Coplanar Waveguide Bandpass Filter—A Ribbon–of–Brick–Wall Design", IEEE Trans. on Microwave Theory & Tech. vol. 43, No. 7, Jul., 1995, pp. 1589–1596.

*Primary Examiner*—Seungsook Ham
*Attorney, Agent, or Firm*—Steven J. Adamson; Edward B. Anderson

[57] ABSTRACT

A slot line band pass filter formed on a dielectric substrate. In one embodiment, the filter includes input and output positive and negative signal conductors and resonators for coupling a signal of a desired frequency between input and output conductors. Various resonator arrangements are disclosed. In another embodiment, a filter having a resonator connected to and disposed between positive and negative conductors is taught. In yet other embodiments, filters having loop resonators are disclosed.

25 Claims, 3 Drawing Sheets

SLOT LINE BAND PASS FILTER

FIELD OF THE INVENTION

The present invention relates to slot line band pass filters.

BACKGROUND OF THE INVENTION

The prior art provides several types of filters for use with radio frequency signals including high pass, low pass, band pass, notch and other types of filters fabricated in lumped or distributed form. Filters of these types have been formed in a variety of transmission media.

With respect to band pass filters, filters of this type have been formed in microstrip transmission media using distributed elements. Microstrip transmission media generally consists of one or more thin conducting strips of finite width parallel to a single extended conducting ground plan. In its common form, the strips are fixed to an insulting substrate attached to the ground plane. Filters fabricated in microstrip transmission media are disadvantageous in that the formation is process intensive involving metalization on two sides of a substrate and occasionally the formation of interconnecting vias therebetween to achieve proper grounding.

Prior art band pass filters also include some filters formed in coplanar (CPW) waveguide transmission media. Coplanar waveguide transmission media consists of a single thin conducting strip of finite width situated between two semi-infinite ground planes and separated from them by finite gaps. The conducting strips and ground planes are affixed to the same planar surface of an insulating substrate of arbitrary thickness. An example of a CPW band pass filter is disclosed in Coplanar Waveguide Band Pass Filter—A Ribbon-of-Brick-Wall Design, by Lin et al., IEEE, 1995.

Slot line transmission media is another type of known transmission media. One beneficial aspect of this transmission media is that it affords uniplanar fabrication. A need does exist, however, to provide band pass filters in slot line transmission media, particularly filters with improved performance, desirable rejection profiles and compact designs.

SUMMARY OF THE INVENTION

Accordingly, it is an object of the present invention to provide a slot line band pass filter.

It is another object of the present invention to provide a slot line band pass filter that affords flexibility in the design of performance characteristics.

It is another object of the present invention to provide such a band pass filter that is compact in size.

These and related objects of the present invention are achieved by use of the slot line band pass filter disclosed herein.

The attainment of the foregoing and related advantages and features of the invention should be more readily apparent to those skilled in the art, after review of the following more detailed description of the invention taken together with the drawings.

DETAILED DESCRIPTION

Slot line transmission media generally consists of two semi-infinite coplanar conductors affixed to the same side of an insulating substrate of arbitrary thickness and separated by a finite gap. With respect to other transmission media, slot line embodiments are relatively non-consumptive of substrate area and provide flexibility of component layout. Slot line embodiments also provide the benefits of uniplanar fabrication, including all circuit elements being formed on one side of the substrate and avoiding the formation of interconnecting vias. The filters described herein are preferably formed on a substrate that may include fused silica, ceramic, plastic, Teflon, glass, air, or the like. The positive and negative conductors are preferably configured as strip lines (as shown), though the use of ground planes is also contemplated and is within the present invention.

Figure 1:
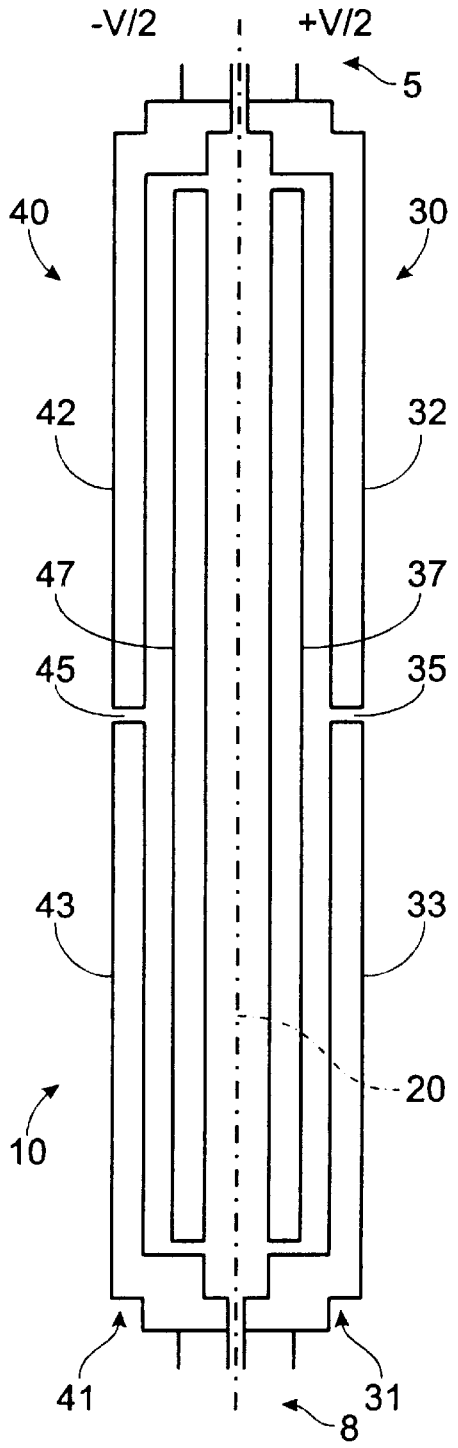
FIG. 1 is a diagram of a slot line band pass filter in accordance with the present invention.

Referring to FIG. 1, a diagram of a slot line band pass filter in accordance with the present invention is shown. The filter 10 is coupled to an input signal line 5 and an output signal line 8, each consisting of a positive line (indicated as +V/2) and a negative line (indicated as −V/2). The input signal line (or input slot line transmission media) 5 thus includes a positive input signal conductor 5 (V+/2) and a negative input signal conductor 5 (V−/2). The output signal line (or output slot line transmission media) 8 similarly includes a positive output signal conductor and a negative output signal conductor. Filter 10 has a positive half coupled to the positive lines and a negative half coupled to the negative lines. The positive and negative halves are preferably symmetric about a dash-dot center line 20. The potential at center line 20 is the difference between the signals on the positive and the negative conductors and is effectively ground, i.e., a virtual ground.

Filter 10 comprises a first (or input) positive signal conductor 32 and a second (or output) positive signal conductor 33, separated by a gap 35. Conductors 32,33 are component parts of a positive filter conductor or positive conductor line (as discussed in more detail below) and conductors 32,33 may also be referred to as segments. Filter 10 also comprises a first (or input) negative signal conductor 42 and a second (or output) negative signal conductor 43, separated by gap 45. Conductors 42,43 are component parts of a negative filter conductor or negative conductor line (as discussed in more detail below) and conductors 42,43 may also be referred to as segments. It should be recognized that the positive and negative signal conductors can be interchanged such that a signal is propagated from a positive to a negative conductor or vice versa as is known in the art. Hence the terms positive and negative are used here for convenience in describing the filter and it is to be understood that they may be interchanged.

A positive resonator 37 is provided in a preferably substantially parallel relationship with conductors 32,33 and a negative resonator 47 is provided in a preferably substantially parallel relationship with conductors 42,43. The conductors 32,33 and resonator 37 form a positive signal path 30 while conductors 42,43 and resonator 47 form a negative signal line 40. The symmetric arrangement of signal paths 30,40 supports two fundamental modes of signal propagation, an odd mode and an even mode.

In operation, signals propagating at the design or center frequency are electromagnetically coupled from conductor 32 to conductor 33 through resonator 37 on the positive side and from conductor 42 to conductor 43 through resonator 47 on the negative side.

The selection of component geometry to achieve a desired center frequency and bandwidth are generally as follows. The center frequency is achieved by configuring the first and second positive conductors 32,33 and the first and second negative conductors 42,43 to have a length of one-quarter wavelength of the center frequency, fc, and by configuring the resonator to have a length of approximately one-half wavelength at that frequency. It should be recognized that undesirable pass bands occur at multiples of the half wavelength frequency, which can be attenuated by compensating the filter to equalize even and odd mode phase velocities.

With respect to bandwidth, this is determined by the ratio of the even mode to odd mode capacitance which in turn is determined by the positioning of conductors 32,33,42,43 and resonators 37,47 with respect to center line 20 and to each other. The odd mode capacitance exists between the preferably straight line defined by conductors 32,33 (hereinafter sometimes referred to as the "positive conductor line 31" or "positive filter conductor 41") and resonator 37 and between the preferably straight line defined by conductors 42,43 (hereinafter sometimes referred to a "negative conductor line 41" or "negative filter conductor 41") and resonator 47. The magnitude of this capacitance is dependent upon the respective distance, $d_{odd\text{-}mode}$, of resonators 37,47 from conductor lines 31,41. As the distance between the conductor lines 31,41 and the respective resonator 37,47 increases, the odd mode capacitance decreases.

The even mode capacitance exists between resonators 37,47 and virtual ground center line 20, and between positive and negative conductor lines 31,41 and virtual ground center line 20. As distance, $d_{even\text{-}mode}$, of the conductor lines 31,41 and resonators 37,47 from the center line 20 decreases, the even mode capacitance or capacitive coupling increases.

The relationship of even mode and odd mode capacitances to bandwidth is that the bandwidth of a filter increases as odd mode capacitance increases and as even mode capacitance decreases. Thus, as the distance between positive and negative conductor lines 31,41 and their respective resonators 37,47 increases, the filter bandwidth is reduced. Similarly, as the distance between lines 31, 41 and their respective resonators 37,47 decreases, the filter bandwidth is increased.

Figure 2:
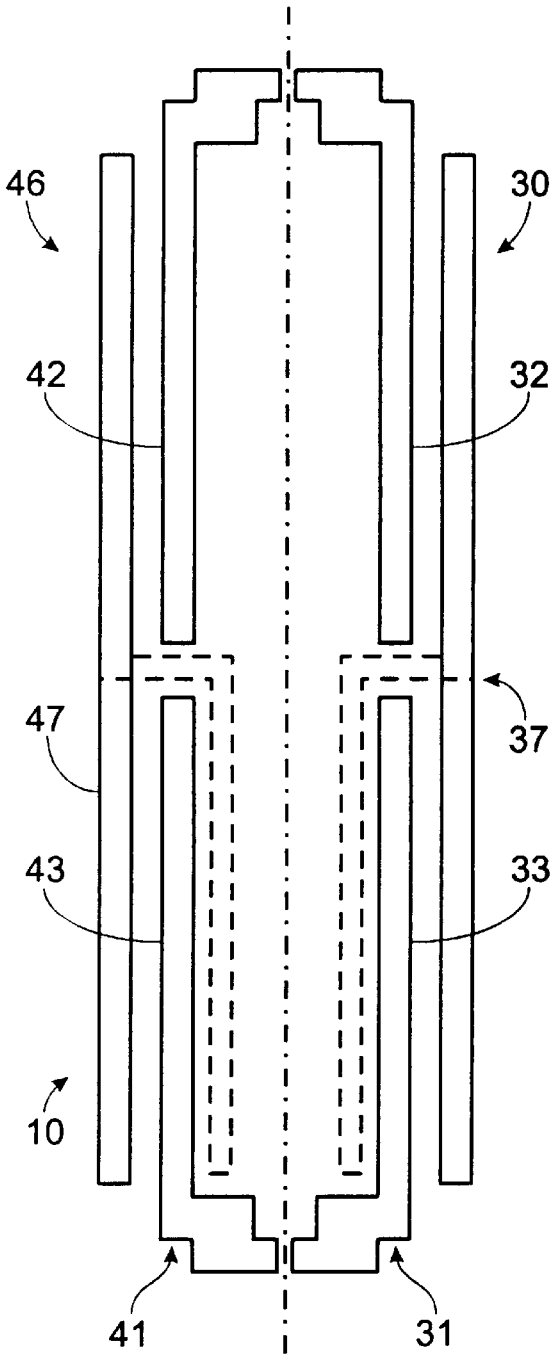
FIG. 2 is a diagram of another embodiment of a slot line band pass filter in accordance with the present invention.

Referring to FIG. 2, a diagram of another embodiment of a slot line band pass filter in accordance with the present invention is shown. In the embodiment of FIG. 2 resonators 37,47 are placed outside of signal line 31,41. Such an arrangement reduces even mode capacitance because the distances between resonators 37,47 and virtual ground center line 20 increases. It should also be recognized that resonators 37,47 may be positioned in-part inside of signal line 31,41 and in-part outside of signal line 31,41 as indicated by dashed lines 37',47' (the bottom half of resonators 37,47 would not be present in such an embodiment). The ability to position resonators on either side of their respective conductor lines gives a designer significant flexibility in the selection of pass bandwidth and filter layout.

Another benefit of the slot line band pass filter of the present invention is higher impedance, particularly compared to microstrip embodiments. This higher impedance allows for significantly wider bandwidth for a given spacing between conductor line and resonator, and thus obviates the need for additional up impedance transforming to achieve wide bandwidths within manufacturable conductor line to resonator spacing.

While the resonators of FIGS. 1 and 2 and others herein are shown in a generally symmetric arrangement about center line 20, it should be recognized that the resonators can be arranged asymmetrically.

Figure 3:
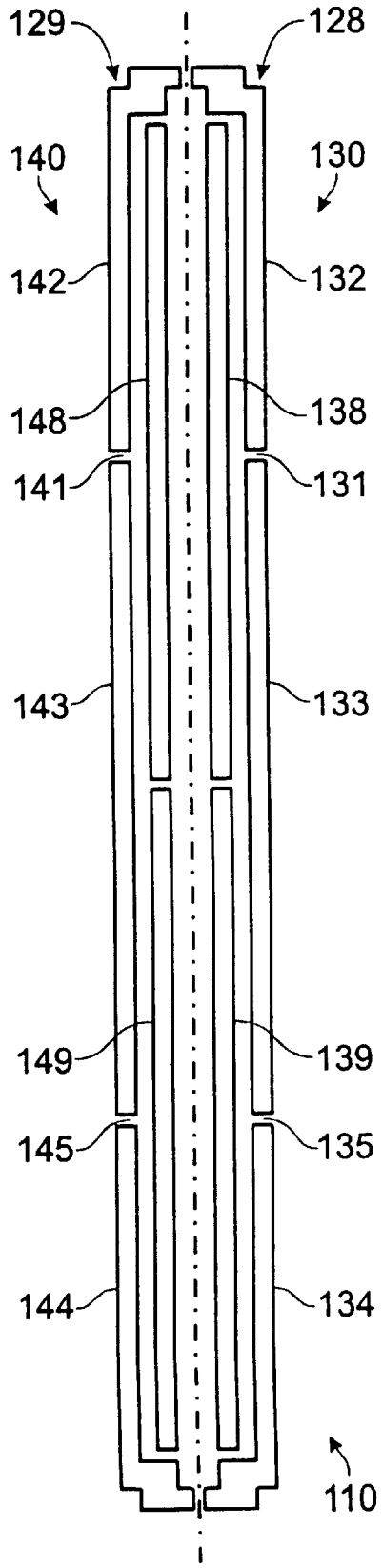
FIG. 3 is a diagram of another embodiment of a slot line band pass filter in accordance with the present invention.

Referring to FIG. 3, a diagram of an alternative embodiment of a slot line filter 110 in accordance with the present invention is shown. Filter 110 includes a positive signal path 130 comprised of first (or input) and second (or output) conductors 132,134 (which form a positive filter conductor having conductive segments therein) and three resonators 133,138,139. Conductors 132, 134 are formed in a linear arrangement with resonator 133 to form a positive conductor line 128 and are separated from resonator 133 by gaps 131,135, respectively. Resonators 138,139 flank the linear arrangement of first conductor 132, resonator 133 and second conductor 134. Filter 110 also includes a negative signal path 140 comprised of first and second conductors 142,144 (which form a negative filter conductor having conductive segments therein) and three resonators 143,148,149. Conductors 142,144 are formed in a linear arrangement with resonator 143 to form a negative conductor line 129 and are separated from resonator 143 by gaps 141,145, respectively. Resonators 148,149 flank the linear arrangement of first conductor 142, resonator 143 and second conductor 144.

In operation, signals propagating at the design frequency are coupled from first conductor 132 to resonator 138 and then to resonator 133 from where they are coupled to resonator 139 and then to second conductor 134. Signal propagation occurs in an analogous manner in negative signal line 140. Each resonator 133,138,139, 143,148,149 is preferably approximately one-half wavelength of the design frequency. It should be recognized, however, that the coupling and frequency are adjusted according to filter type, e.g., Chebychev, Butterworth, elliptic, etc., amongst other known parameters.

Figure 5:
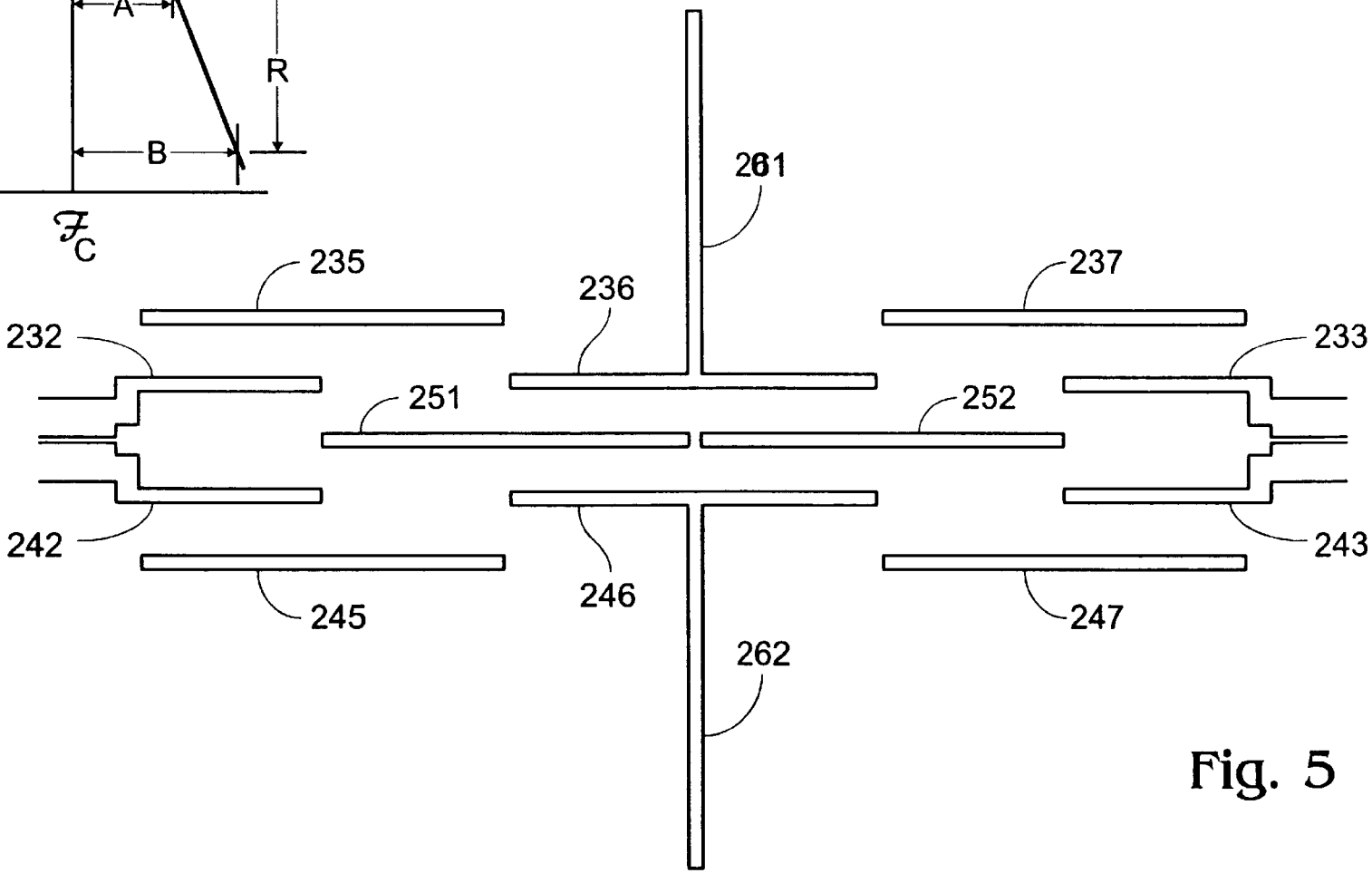
FIG. 5 is a diagram of another embodiment of a slot line band pass filter in accordance with the present invention.

With respect to implementing a desired design frequency, this is achieved by the relative arrangement of conductors 132,134,142,143 and resonators 133,138,139, 143,148,149 as discussed above with respect to FIG. 1A. It should also be recognized that the resonators 133,138,139, 143,148,149 may be arranged other than as shown in FIG. 3, for example, one or more resonators (including all resonators) may be provided outside of the conductors (for example, as shown in FIG. 5 below) or arranged asymmetrically. The provision of multiple resonator segments provides the designer with enhanced latitude in achieving desired filter characteristics, including bandwidth and rejection profile.

Figure 4:
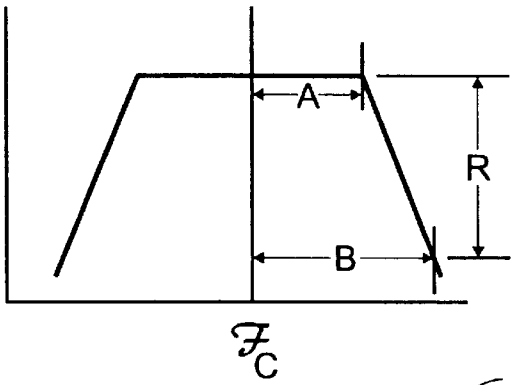
FIG. 4 is a frequency diagram illustrating pass bandwidth.

Referring to FIG. 4, a diagram of pass band frequency is shown. The diagram and the equations below demonstrate that filter rejection outside the pass band, i.e., the steepness of the filter response, increases proportionately with the order of the filter. The order of the filter is defined as the number of half wave resonators per positive or negative signal line and thus filter 10 is a first order filter, while filter 110 is a third order filter. The relationship between filter rejection, bandwidth and filter order is approximately as follows:

$$R = (20)(n)\log_{10}(A/B), \text{ where}$$

$$A = \text{half of filter pass bandwidth.}$$

-continued $B$ = frequency offset from center where rejection is calculated, and $n$ = filter order.

This formula is used to approximate the required filter order to achieve a given level of rejection, R, at a given offset frequency, B.

Referring to FIG. 5, a diagram of another embodiment of a slot line band pass filter 210 in accordance with the present invention is shown. Filter 210 includes a positive and a negative input conductor 232,242 and a positive and a negative output conductor 233,243. A plurality of overlapping resonators 235–237, 245–247 and 251–252 couple signals of a design frequency from input to output. The input and output conductors are preferably one-quarter wavelength of the design frequency and the resonators are preferably one-half wavelength of the design frequency.

Electromagnetic energy is coupled through filter 210 via two paths. A first path is sequentially through resonators 235, 251, 236, 252 and 237, while a second path is sequentially through resonators 245, 251, 246, 252 and 247. Filter 210 illustrates resonators that are inside and outside of the input and output conductors.

Supplemental resonators 261 and 262 are connected (or otherwise coupled) to resonators 236 and 246, respectively. The supplemental resonators are preferably of a length that forces voltage to be zero (and current to be a maximum) and are preferably coupled at the mid-point of resonators 236 and 246, though they may be otherwise configured to obtain a desired filter characteristic. In the embodiment of FIG. 5, the supplemental resonators are preferably one-half wavelength of the design frequency. Additional supplemental resonators could be provided to achieve a desired pass (or rejection) profile.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

We claim:

1. A slot line transmission media band pass filter, comprising:

a substrate of electrically insulating material;

input slot line transmission media formed on said substrate and having a positive conductor and a negative conductor, said positive and negative input signal conductors being oppositely disposed about a center line and equally spaced therefrom;

output slot line transmission media formed on said substrate and having a positive conductor and a negative conductor, said positive and negative output conductors being oppositely disposed about said center line and equally spaced therefrom;

a positive filter conductor formed on said substrate and directly coupled to the positive conductors of said input and said output transmission media, said positive filter conductor having a first positive segment and a second positive segment linearly disposed and separated from one another by a physical gap;

a negative filter conductor formed on said substrate and directly coupled to the negative conductors of said input and said output transmission media, said negative filter conductor having a first negative segment and a second negative segment linearly disposed and separated from one another by a physical gap;

a positive coupling conductor arrangement provided on said substrate at least in part in a spaced, substantially parallel relationship with portions of said first and second segments of said positive filter conductor so as to couple a signal between said positive filter conductor segments; and a negative coupling conductor arrangement provided on said substrate at least in part in a spaced, substantially parallel relationship with portions of said first and second segments of said negative filter conductor so as to couple a signal between said negative filter conductor segments;

wherein said positive filter conductor and said negative filter conductor are oppositely disposed about said center line and spaced from said center line a greater distance than said positive and negative conductors of said input and output slot line transmission media are spaced from said center line.

2. The slot line band pass filter of claim 1, wherein said each of said positive and said negative coupling conductor arrangements includes a resonator conductor.

3. The slot line band pass filter of claim 1, wherein said positive and negative coupling conductor arrangements are provided about said center line in a substantially symmetrical relationship.

4. The slot line band pass filter of claim 1, wherein said positive and negative coupling conductor arrangements are disposed on said substrate substantially inside of said positive and negative filter conductors, respectively.

5. The slot line band pass filter of claim 1, wherein at least one of said positive and negative coupling conductor arrangements is disposed on said substrate substantially outside of its corresponding positive and negative filter conductor.

6. The slot line band pass filter of claim 1, wherein each of said positive and negative coupling conductor arrangements includes a plurality of intercoupled resonator conductors.

7. The slot line band pass filter of claim 6, wherein said resonator of each of said positive and negative coupling conductor arrangements has a length of approximately one-half wavelength of a design frequency or an integer multiple thereof.

8. The slot line band pass filter of claim 1, wherein said positive and negative coupling conductor arrangements are disposed on said substrate substantially outside of said positive and negative filter conductors, respectively.

9. A slot line transmission media band pass filter, comprising:

a substrate of electrically insulating material;

input slot line transmission media formed on said substrate and having a positive conductor and a negative conductor, said positive and negative input signal conductors being oppositely disposed about a center line and equally spaced therefrom;

output slot line transmission media formed on said substrate and having a positive conductor and a negative conductor, said positive and negative output conductors being oppositely disposed about said center line and equally spaced therefrom;

a positive filter conductor formed on said substrate and directly coupled to the positive conductors of said input and said output transmission media, said positive filter conductor having a first positive segment and a second positive segment linearly disposed and separated from one another by a physical gap;

a negative filter conductor formed on said substrate and directly coupled to the negative conductors of said input and said output transmission media, said negative filter conductor having a first negative segment and a second negative segment linearly disposed and separated from one another by a physical gap;

a positive coupling conductor arrangement provided on said substrate at least in part in a spaced, substantially parallel relationship with portions of said first and second segments of said positive filter conductor so as to couple a signal between said positive filter conductor segments; and a negative coupling conductor arrangement provided on said substrate at least in part in a spaced, substantially parallel relationship with portions of said first and second segments of said negative filter conductor so as to couple a signal between said negative filter conductor segments;

wherein the impedance of said filter is determined by the spacing of said positive and negative filter conductors and said positive and negative coupling conductor arrangements from said center line and each other.

10. The slot line transmission media band pass filter of claim 9, wherein each of said positive and said negative coupling conductor arrangements includes a resonator conductor.

11. The slot line transmission media band pass filter of claim 9, wherein said positive and negative coupling conductor arrangements are disposed on said substrate substantially inside of said positive and negative filter conductors, respectively.

12. The slot line transmission media band pass filter of claim 9, wherein at least one of said positive and negative coupling conductor arrangements is disposed on said substrate substantially outside of its corresponding positive and negative filter conductor.

13. The slot line transmission media band pass filter of claim 9, wherein each of said positive and negative coupling conductor arrangements includes a plurality of intercoupled resonator conductors.

14. The slot line transmission media band pass filter of claim 13, wherein said resonator of each of said positive and negative coupling conductor arrangements has a length of approximately one-half wavelength of a design frequency or an integer multiple thereof.

15. The slot line transmission media band pass filter of claim 9, wherein said positive filter conductor and said negative filter conductor are oppositely disposed about said center line and spaced from said center line a greater distance than said positive and negative conductors of said input and output slot line transmission media are spaced from said center line.

16. A slot line transmission media band pass filter, comprising:

a substrate of electrically insulating material;

input slot line transmission media formed on said substrate and having a positive conductor and a negative conductor, said positive and negative input signal conductors being oppositely disposed about a center line and equally spaced therefrom;

output slot line transmission media formed on said substrate and having a positive conductor and a negative conductor, said positive and negative output conductors being oppositely disposed about said center line and equally spaced therefrom;

a positive filter conductor formed on said substrate and having a first positive segment and a second positive segment linearly disposed and separated from one another by a physical gap;

a negative filter conductor formed on said substrate and having a first negative segment and a second negative segment linearly disposed and separated from one another by a physical gap;

a positive coupling conductor arrangement having at least a positive resonator, said positive coupling conductor arrangement being provided on said substrate at least in part in a spaced, substantially parallel relationship with portions of said first and second segments of said positive filter conductor so as to couple a signal between said positive filter conductor segments; and a negative coupling conductor arrangement having at least a negative resonator, said negative coupling conductor arrangement being provided on said substrate at least in part in a spaced, substantially parallel relationship with portions of said first and second segments of said negative filter conductor so as to couple a signal between said negative filter conductor segments;

wherein the physical gap between the linearly disposed segments of said positive filter conductor is less than one-half the length of the positive resonator, and the physical gap between the linearly disposed segments of said negative filter conductor is less than one-half the length of the negative resonator.

17. The slot line transmission media band pass filter of claim 16, wherein said positive filter conductor and said negative filter conductor are oppositely disposed about said center line and spaced from said center line a greater distance than said positive and negative conductors of said input and output slot line transmission media are spaced from said center line.

18. The slot line transmission media band pass filter of claim 16, wherein said positive and negative coupling conductor arrangements are disposed on said substrate substantially inside of said positive and negative filter conductors, respectively.

19. The slot line transmission media band pass filter of claim 16, wherein at least one of said positive and negative coupling conductor arrangements is disposed on said substrate substantially outside of its corresponding positive and negative filter conductor.

20. The slot line transmission media band pass filter of claim 17, wherein each physical gap is less than a third of the length of the corresponding resonator.

21.A slot line transmission media band pass filter, comprising:

a substrate of electrically insulating material;

input slot line transmission media formed on said substrate and having a positive conductor and a negative conductor, said positive and negative input signal conductors being oppositely disposed about a center line and equally spaced therefrom;

output slot line transmission media formed on said substrate and having a positive conductor and a negative conductor, said positive and negative output conductors being oppositely disposed about said center line and equally spaced therefrom;

a positive filter conductor formed on said substrate and having a first segment and a second positive segment linearly disposed and separated from one another by a physical gap;

a negative filter conductor formed on said substrate and having a first segment and a second negative segment linearly disposed and separated from one another by a physical gap;

a positive coupling conductor coupling conductor arrangement having a plurality of positive resonators, said positive coupling conductor arrangement being provided on said substrate at least in part in a spaced, substantially parallel relationship with portions of said first and second segments of said positive filter conductor so as to couple a signal between said positive filter conductor segments; and a negative coupling conductor arrangement having a plurality of negative resonators, said negative coupling conductor arrangement being provided on said substrate at least in part in a spaced, substantially parallel relationship with portions of said first and second segments of said negative filter conductor so as to couple a signal between said negative filter conductor segments;

wherein at least two of said positive resonators are provided in a linear, gapped manner and the physical gap between these two positive resonators is less than half of the length of any of said positive resonators; and wherein at least two of said negative resonators are provided in a linear, gapped manner and the physical gap between these two negative resonators is less than half of the length of any of said negative resonators.

22. The slot line transmission media band pass filter of claim 21, wherein said positive filter conductor and said negative filter conductor are oppositely disposed about said center line and spaced from said center line a greater distance than said positive and negative conductors of said input and output slot line transmission media are spaced from said center line.

23. The slot line transmission media band pass filter of claim 21, wherein the impedance of said filter is determined by the spacing of said positive and negative filter conductors and said positive and negative coupling conductor arrangements from said center line and each other.

24. The slot line transmission media band pass filter of claim 21, wherein each of said physical gaps is less than one third the length of any of the corresponding resonators.

25. The slot line transmission media band pass filter of claim 1, wherein the impedance of said filter is determined by the spacing of said positive and negative filter conductors and said positive and negative coupling conductor arrangements from said center line and each other.

* * * * *